US005331989A

United States Patent [19]

Stephens

[11] Patent Number: 5,331,989

[45] Date of Patent: Jul. 26, 1994

[54] WALKING AID

[76] Inventor: Thomas P. Stephens, HCR 6, Box 47B, Priest River, Id. 83856

[21] Appl. No.: 922,200

[22] Filed: Jul. 30, 1992

[51] Int. Cl.[5] ..... A45B 1/00; A45B 9/04

[52] U.S. Cl. ..... 135/65; 135/71; 135/77; 135/84

[58] Field of Search ..... 135/65 OR, 71, 72, 73, 135/77, 84

[56] References Cited

U.S. PATENT DOCUMENTS

| | | | |
|---|---|---|---|
| 22,171 | 2/1913 | Smith | 135/77 |
| 332,684 | 12/1885 | Tuttle | 135/77 |
| 2,409,365 | 10/1946 | Lamb | 135/65 |
| 2,568,654 | 9/1951 | Neptune . | |
| 2,736,330 | 2/1956 | Wood . | |
| 3,157,187 | 11/1964 | Murcott . | |
| 3,174,494 | 3/1965 | Maguire, Jr. | 135/71 |
| 3,251,372 | 5/1966 | Smith . | |
| 3,517,678 | 6/1970 | Gilsdorf . | |
| 3,741,226 | 6/1973 | Urban | 135/62 |
| 3,757,807 | 9/1973 | Manzo . | |
| 3,768,495 | 10/1973 | Smith | 135/72 |
| 4,151,853 | 5/1979 | Inbar . | |
| 4,196,742 | 4/1980 | Owen, Jr. . | |
| 4,625,742 | 12/1986 | Phillips . | |
| 4,625,743 | 12/1986 | Harker . | |
| 4,630,626 | 12/1986 | Urban | 135/84 |
| 4,708,154 | 11/1987 | Edwards . | |
| 4,730,632 | 3/1988 | Mace | 135/72 |
| 4,756,524 | 7/1988 | Cooney | 272/97 |
| 4,763,680 | 8/1988 | Acosta, Sr. . | |
| 4,790,562 | 12/1988 | Skard | 135/65 |
| 4,796,648 | 1/1989 | Goulter | 135/65 |
| 4,899,771 | 2/1990 | Wilkinson . | |
| 4,958,650 | 9/1990 | Dale | 135/65 |
| 5,103,850 | 4/1992 | Davis | 135/84 |
| 5,193,567 | 3/1993 | Razny, Jr. | 135/71 |
| 5,224,506 | 7/1993 | Allen et al. | 135/67 |

FOREIGN PATENT DOCUMENTS

| | | | |
|---|---|---|---|
| 0023321 | 1/1901 | Switzerland | 135/77 |
| 0123814 | 3/1919 | United Kingdom | 135/71 |

*Primary Examiner*—Carl D. Friedman
*Assistant Examiner*—Wynn E. Wood
*Attorney, Agent, or Firm*—Kathleen A. Skinner

[57] ABSTRACT

A walking aid which has an elongated shaft which is curved along its longitudinal axis in the plane of forward direction and a handgrip disposed along its longitudinal axis in a rearward direction and contoured to support the hand with separated thumb-engaging and fingers-engaging portions and a heel-engaging portion. Another embodiment may have an elongated cuff disposed at the rearward end of the handgrip. This cuff has a lower forearm support portion and an upper forearm engaging portion which provides alignment to the forearm and wrist of the user and an opening for rearward removal of the forearm. A foot member having a bottom portion of resilient material for frictionally engaging a surface during use is disposed at the lower end of the shaft.

24 Claims, 7 Drawing Sheets

WALKING AID

BACKGROUND OF THE INVENTION

This invention relates generally to walking aids, and more particularly, to a crutch or cane constructed to distribute a person's weight to minimize stress on the user's wrist.

Walking aids have evolved over time from simple wooden sticks to specialized canes and crutches to assist persons with temporary or chronic disabilities in walking. Most canes employ a straight vertical support member which contacts the ground and a generally horizontal hand grip attached to the vertical member. Persons with longer-term disabilities usually use a crutch of the "Canadian" type, which has an extension to the vertical member to which is mounted a cuff assembly which gives additional support and control to the forearm of the user.

There are a number of inherent problems with crutches and canes, and particularly with crutches for long term use. For one thing, much of the weight that would otherwise be supported by the legs must be supported by the arms of a crutch user and, as a result, the hand and wrist joints experience a great deal more stress than was intended for those joints. Most prior art crutch designs force the hand to be held in a horizontal position which places uneven weight on the wrist joint, leading to chronic pain and certain types of joint degeneration in long term users.

In addition, most Canadian style crutches and canes use a straight shaft or a shaft which is straight in the forward direction to contact the ground. This straight shaft transfers the impact shock of the shaft striking the ground directly to the wrist and arm of the user, further increasing the stress on the wrist and hands.

In addition, most crutches are assembled from lightweight metal tubing and have some adjustable parts which allow the crutches to be modified to fit users of different heights and weights. However, for most crutch users, once the crutch is fitted, it is never adjusted again. The adjustment mechanisms, however, which are relatively complex, continue to contribute significantly to the weight of the crutch and are usually the first point of mechanical failure in the crutch. In addition, the typical attachments and adjustments to metal crutches are usually noisy and contribute to the discomfort of the user.

Most crutches and canes also have conventional rubber foot grips at the bottom of the shaft with grooves to engage and grip the ground. However, these relatively small pads have treads located only on the bottom surface which provide full stability only when the crutch is perpendicular to the ground. There is reduced gripping action with these foot grips when the crutch is angled at the beginning or end of a walking stride.

Although the prior art has attempted to provide solutions for some of these problems of long term crutch users, there has been a longstanding need for a lightweight crutch which has no mechanical parts, which redistributes the weight of the user in an ergonomic manner, which reduces the impact forces of the crutch striking the ground and which provides stability and balance through the full range of a walking motion.

SUMMARY OF THE INVENTION

Accordingly, the present invention provides a walking aid which has an elongated shaft which is curved along its longitudinal axis in the plane of forward direction to provide a spring action to the walking movement and to reduce the impact forces created when the walking aid strikes the ground. A hand grip is attached to the upper end of the elongated shaft and extends along its longitudinal axis in a rearward direction of the shaft. The hand grip is contoured to support the hand of the user and has at its forward end a thumb-supporting portion and a fingers-engaging portion on opposite sides of its longitudinal axis which distributes the weight of the body over the surface of the hand and provides the hand with lateral control of the walking aid. The hand grip also has at its rearward end a heel-engaging portion for engaging the heel of the hand. This heel engaging portion is preferably higher than the forward end of the hand grip so that the thumb and fingers are aligned downwardly from the wrist to relieve the stress on the wrist joint and redistribute the weight of the user to the palm of the hand and the thumb and fingers. A foot member, disposed on the bottom of the elongated shaft, is formed of resilient material to frictionally engage the ground or other surface during use of the walking aid. The bottom portion of the foot member is upwardly curved at its forward and rearward ends so that it can roll and grip the surface throughout most of the range of motion of the walking procedure.

In one embodiment of the invention, an elongated cuff is joined to the rearward end of the hand grip. The elongated cuff has a lower forearm support portion and an upper forearm engaging portion which provides alignment to the forearm and wrist of the user. In a preferred embodiment, the elongated shaft, the hand grip and elongated cuff are integrally joined to each other, eliminating the weight and inconvenience of breakable and noisy adjustment mechanisms.

Other objects, features and advantages of the invention shall become apparent with reference to the following description and to the drawings.

DESCRIPTION OF THE PREFERRED EMBODIMENT

Figure 1:
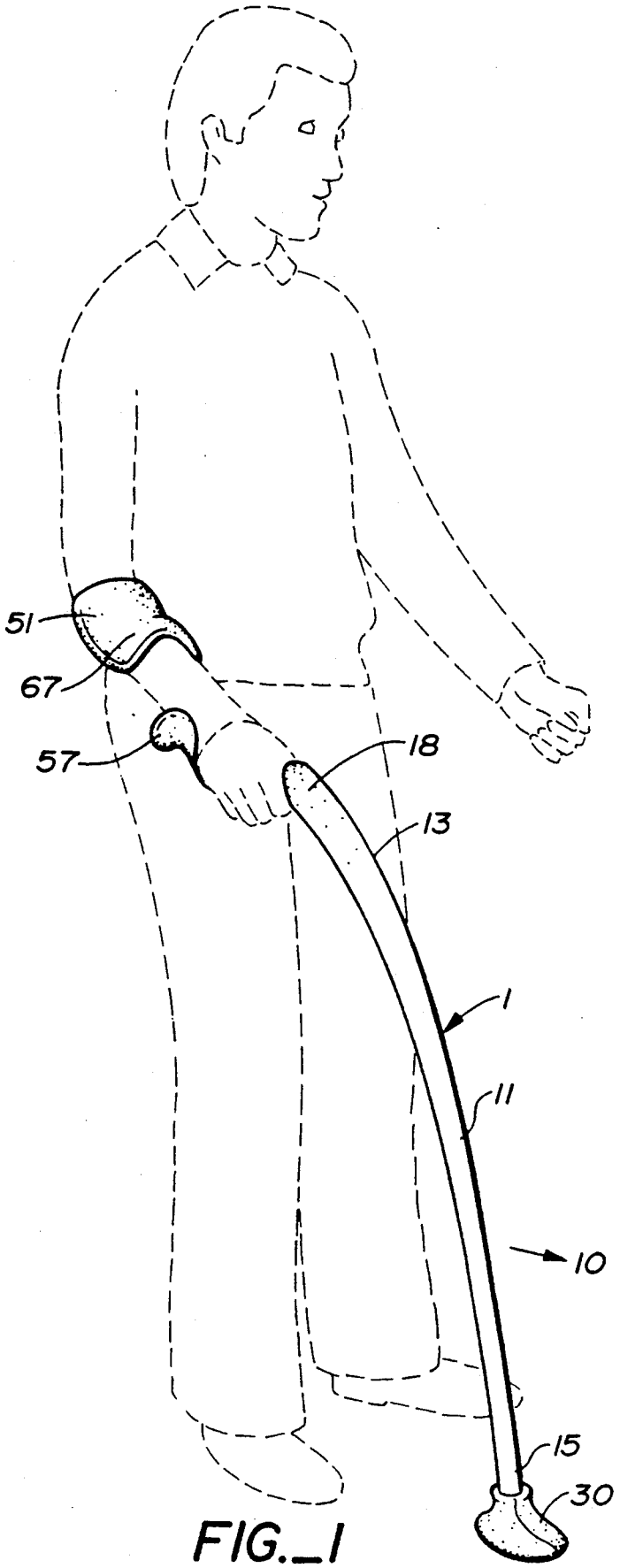
FIG. 1 is a perspective view of a right-hand version of a crutch of the present invention, illustrating a typical position of forward movement.

One embodiment of the novel walking aid of this invention is a crutch 1 shown in use in FIG. 1. This illustration shows only a right-hand crutch for convenience. In actual use, most long-term users of crutches would also require a left-hand crutch, which would be a mirror image of the right-hand crutch. Throughout this description the term "inner" is used to refer to the position of the crutch which is closest to the body of the user; the term "outer" refers to the side of the crutch most distant from the body of the user. The term "forward direction" refers to a direction in front of the person, which is in the direction of walking shown by arrow 10. "Rearward" is in the opposite direction of arrow 10.

The walking aid of this invention includes an elongated shaft 11 having an upper end 13 and a lower end 15, the shaft being curved along its longitudinal axis in the plane of the forward direction of the walking aid, designated by arrow 10. Preferably, the forward curve is gradual and nearly continuous from the upper end 13 to the lower end 15 and is convex-shaped facing the plane of forward direction. The purpose of this bowed shaft is to reduce the impact force on the user as the crutch strikes the ground and to give a spring effect to the forward momentum of the user when using a walking motion, as can be seen in FIG. 1. As weight bears down on the crutch, there is a "loading" of the energy in the elongated shaft and as the user moves forward, there is a subsequent release of stored energy which propels the user in a forward direction.

The elongated shaft 11 is also curved slightly outwardly in a concave curve in a plane lateral to the body to accommodate the shape of the body and to assist the foot member 30 disposed on the lower end 15 of the shaft to contact the ground in a more perpendicular manner as the crutch moves away from the body. The shaft may be made so that it is round in cross-section at its lower end 15 and more elliptical in cross-section in a forward plane at its upper end 13.

The walking aid 1 or 2 also has a novel handgrip 17 disposed at the upper end 13 of the elongated shaft 11. The handgrip has a forward end 18 and is disposed along its longitudinal axis in a rearward direction of the elongated shaft. The handgrip is contoured to support the hand of the user, with a thumb-supporting portion 21 and a fingers-engaging portion 23 disposed at the forward end of the hand grip on opposite sides of its longitudinal axis. A heel-engaging portion 27 for engaging the heel of a hand is disposed at the rearward end of the handgrip and, in a preferred embodiment, the heel-engaging portion is disposed upwardly of the thumb-supporting portion so that the thumb and fingers of the user will be aligned downwardly from the user's wrist. The forward end of the handgrip preferably has a projecting portion 19 which projects upwardly along the longitudinal axis of the elongated shaft 11. On the inner side of the projecting portion is the thumb-supporting portion, which is a concavity or shelf shaped to provide a stop for the thumb and to hold it as it is supported downwardly from the hand. The thumb-supporting portion of the handgrip of this invention allows the thumb bones, which are the strongest bones in the hand, to support some of the weight of the body typically borne by the wrist and fingers.

The projecting portion 19 of the hand grip is contoured to support the portion of the hand between the thumb and index finger, to separate and support the thumb and the fingers and to anchor the hand from sliding forward. On the outer side of the projecting member is a fingers-engaging portion 23, which may include a contoured indentation 29 for the index finger with a small projection 28 separating the indentation 29 from the surface 23 which is contoured to receive the remaining fingers. The thumb-supporting portion 21, projecting portion 19 and fingers-engaging portion 23 of the handgrip was formed to provide a specific anchor for the thumb and fingers which provides rotational control of the handgrip, thereby increasing the confidence and stability of the user of the walking aid.

The underside 23 of the handgrip 17 may have a smooth surface or it may be shaped to receive the tips of the fingers; an upper surface 25 of the handgrip 17 is disposed longitudinally between the projecting portion 19 and the heel-engaging portion 27 and is contoured to support the inner surface of the hand of the user and to distribute the pressure on the base of the hand over the widest possible area. The handgrip should be wide and thick enough so that the fingers and thumb of the hand will be comfortably separated and downwardly aligned to grasp the handgrip without completely surrounding the handgrip or having to unduly constrict the hand to maintain a grip.

The heel-engaging portion 27 of the handgrip 17 is a broad upper portion of the handgrip which is contoured in a somewhat concave shape to receive and seat the heel of the hand. The heel-engaging portion may have an inclined back 26 which supports the wrist in an ergonomic position. The entire handgrip is angled approximately 45° from the vertical axis in order to align the wrist and hand relative to the arm and the rest of the body and to most evenly distribute the impact forces and weight of the body across the hands and wrist joints.

Figure 6:
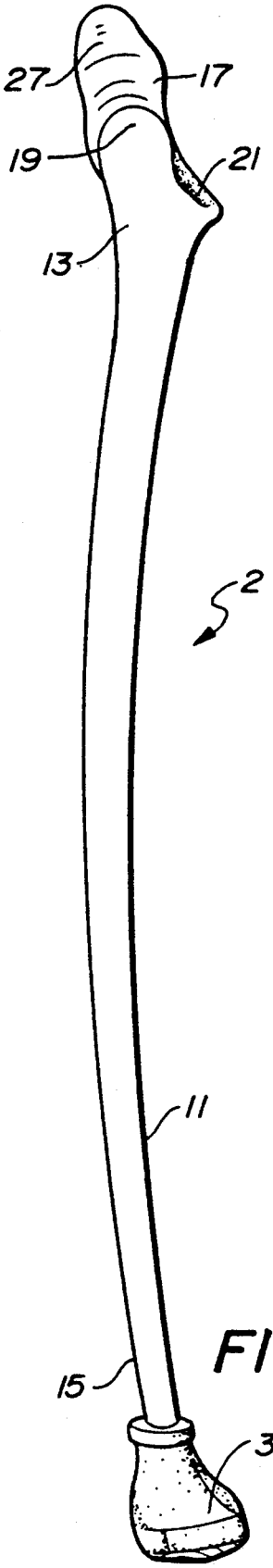
FIG. 6 is a front elevational view of a right-hand cane of the present invention.
Figure 7:
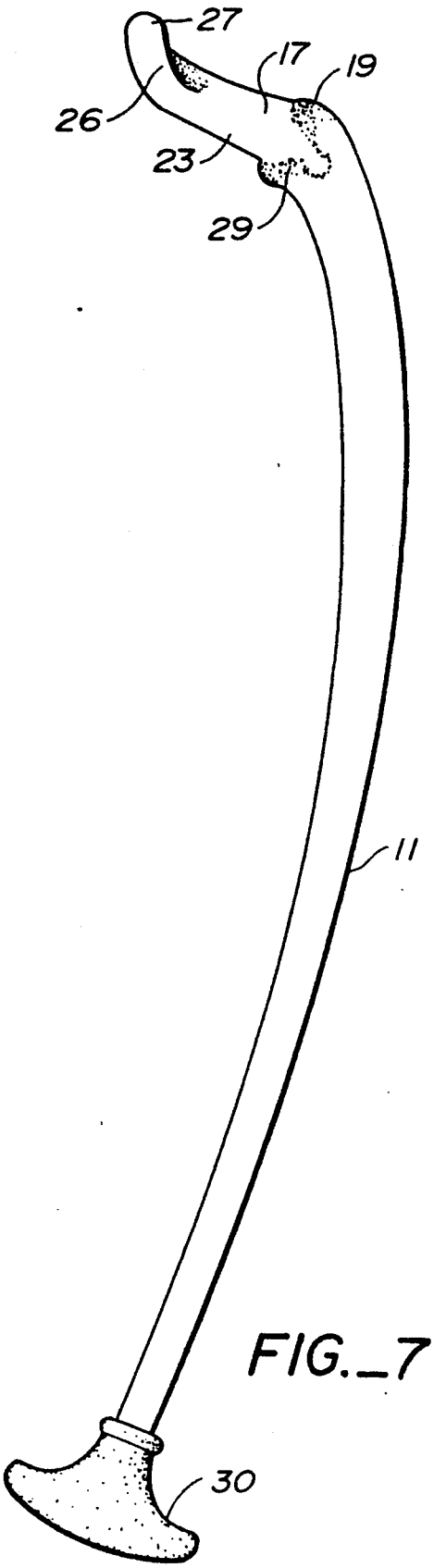
FIG. 7 is a side elevational view of the cane of FIG. 6.
Figure 8:
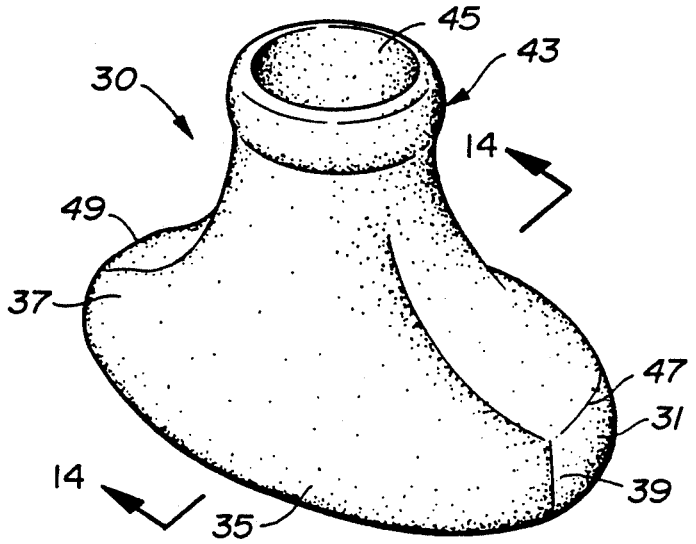
FIG. 8 is a perspective view of the foot member of the present invention from its outer side.
Figure 9:
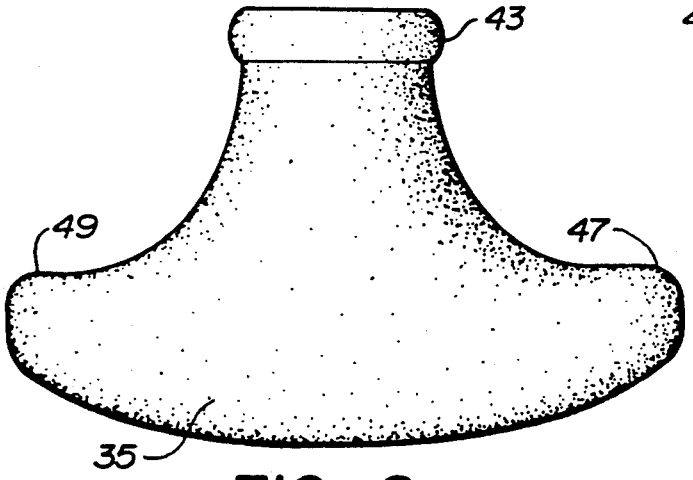
FIG. 9 is a side elevational view of the foot member showing its outer side.
Figure 14:
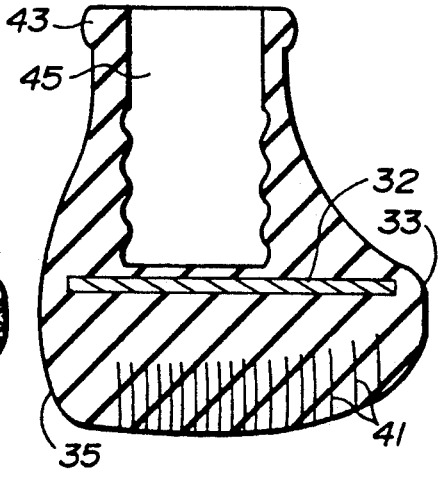
FIG. 14 is a cross-sectional view taken along line 14—14 of FIG. 8.
Figure 10:
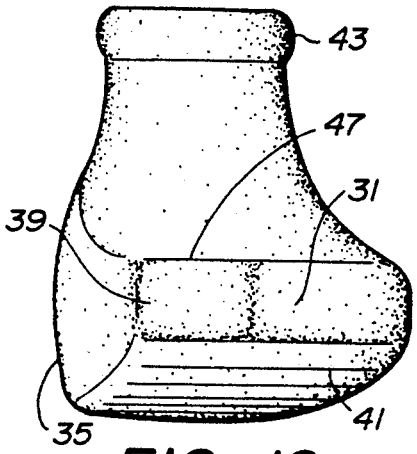
FIG. 10 is a front elevational view of the foot member.
Figure 11:
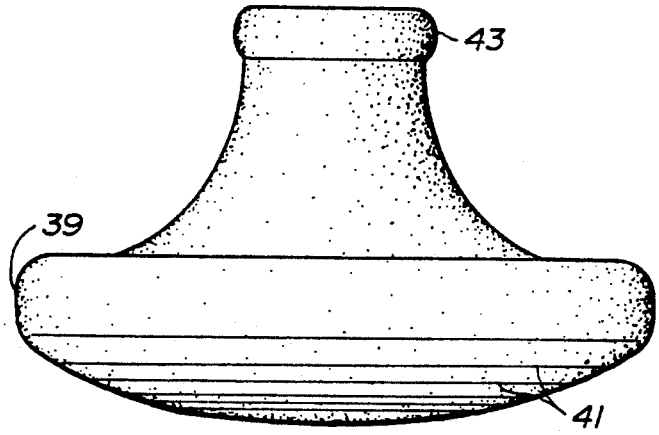
FIG. 11 is a side elevational view of the foot member showing its inner side.
Figure 12:
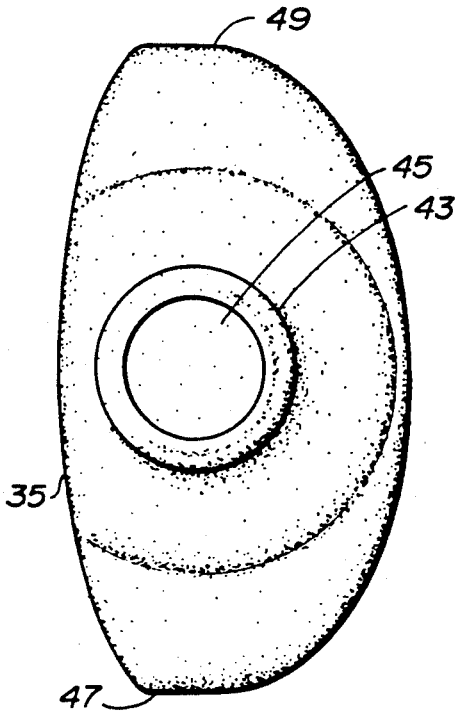
FIG. 12 is a top plan view of the foot member.
Figure 13:
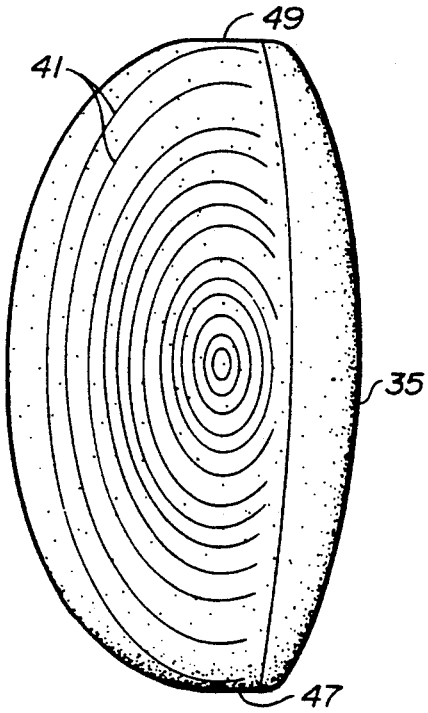
FIG. 13 is a bottom plan view of the foot member.

It can be appreciated that the walking aid of this invention may be a cane 2, as illustrated in FIGS. 6 and 7. The bowed elongated shaft 11 of the cane provides a spring action and the handgrip 17 distributes the force on the hand to relieve some of the pressure on the wrist and also provides the user with rotational control because of its thumb and finger-holds.

For those who require the additional support and control of a "Canadian style" crutch, another embodiment of the invention is a crutch 1 which has an elongated cuff 51, as illustrated in FIGS. 1, 1A, and 2 through 5. The elongated cuff has a lower forearm support portion 53 which is joined to the rearward end of the handgrip 17. The lower forearm support portion is inclined upwardly from the inclined back 26 of the heel-engaging portion 27 of the handgrip 17.

Figure 1A:
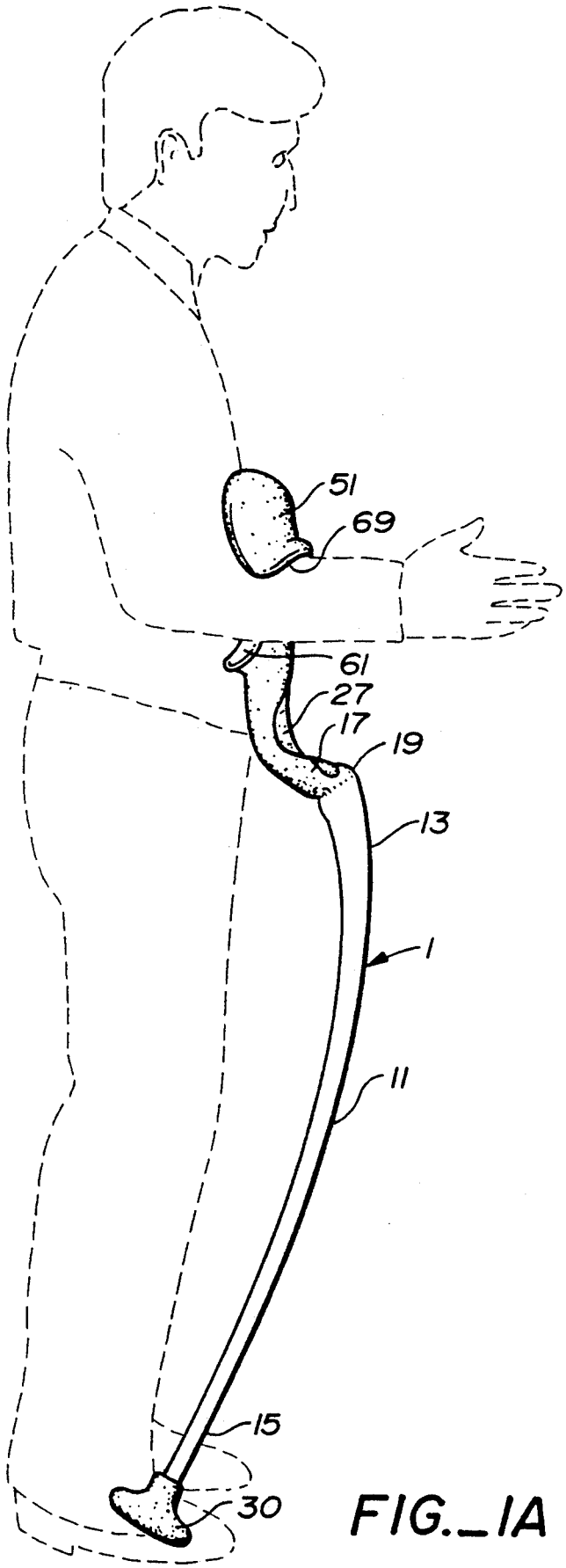
FIG. 1A is a perspective view of the invention illustrating the crutch in a resting position.
Figure 2:
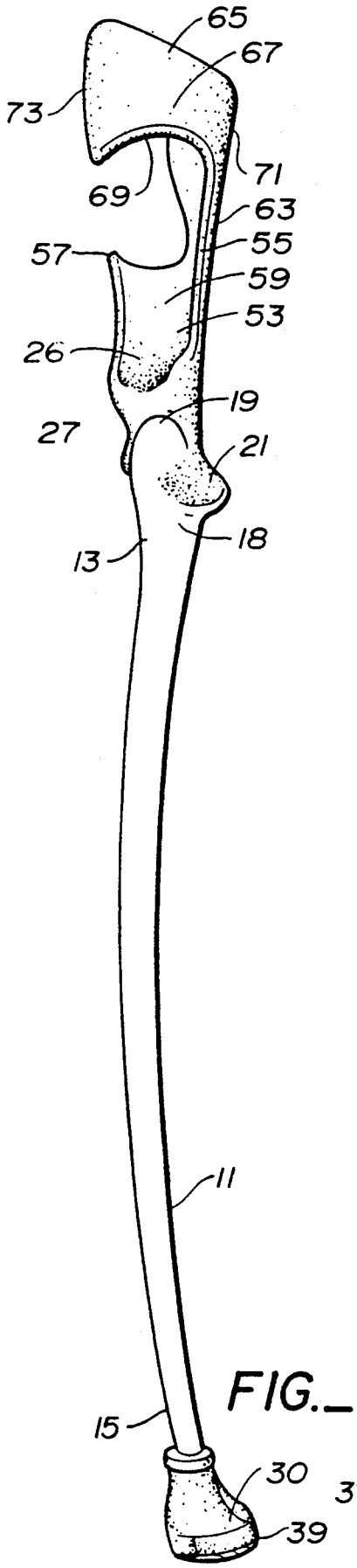
FIG. 2 is a front elevational view of a crutch of the present invention.
Figure 5:
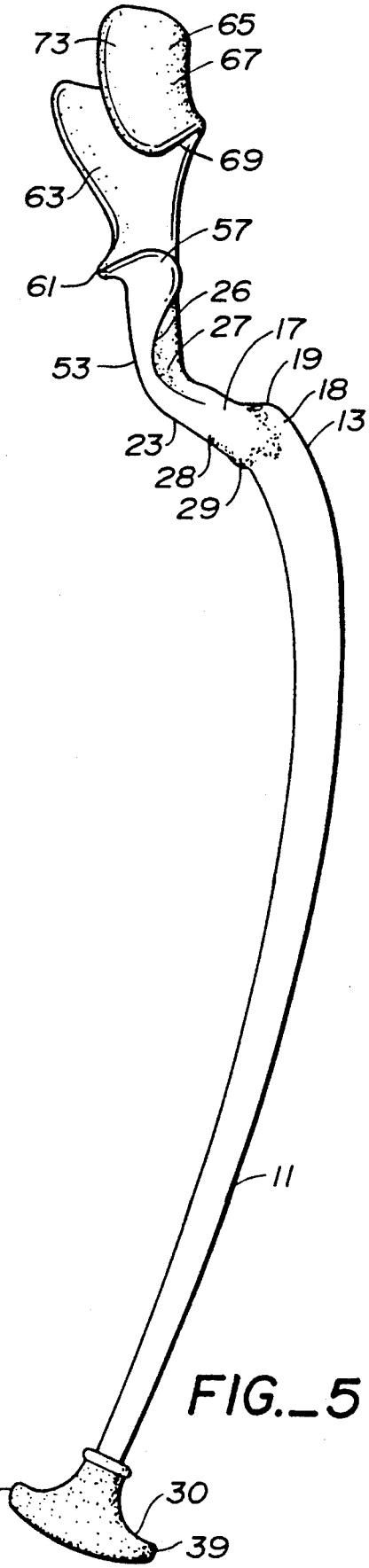
FIG. 5 is a side elevational view of the right (or outer side) of the crutch.
Figure 3:
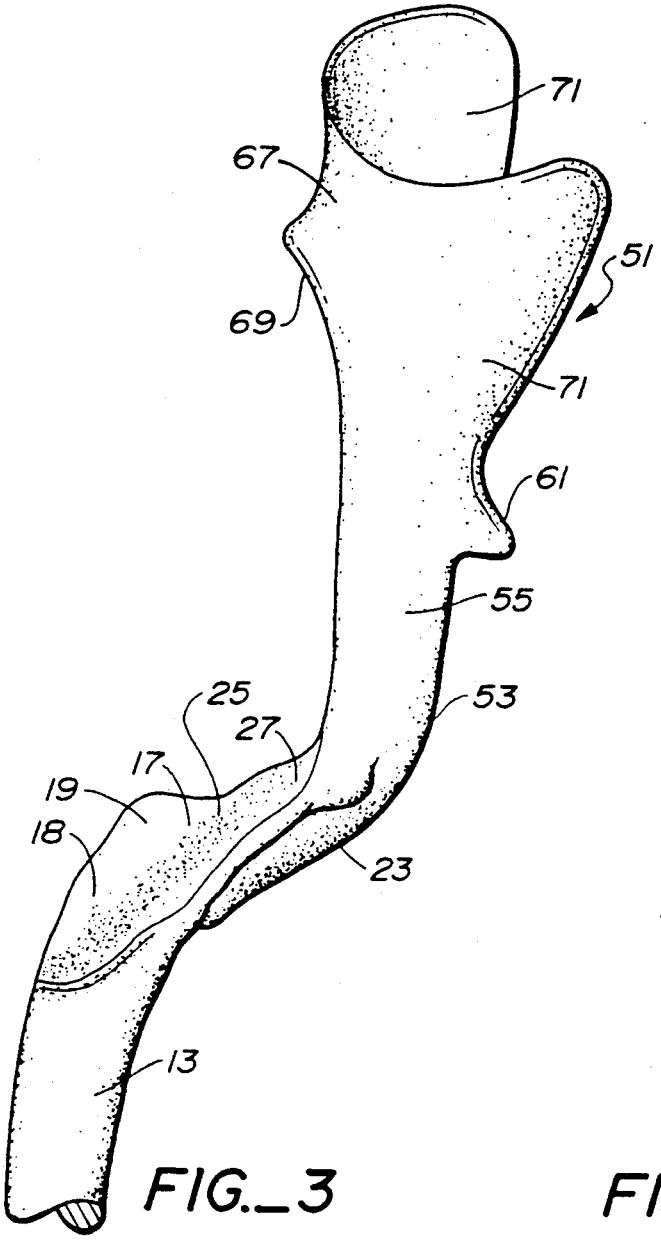
FIG. 3 is a side elevational view of the left (or inner side) of the crutch, with the shaft cut away.
Figure 4:
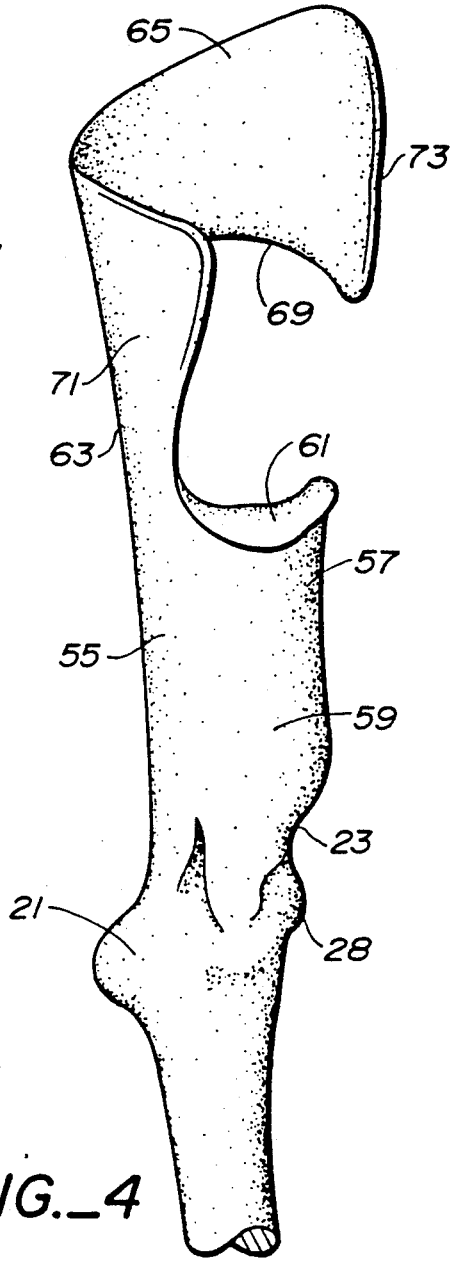
FIG. 4 is a rear elevational view of a crutch of the present invention, with the shaft cut away.

The lower forearm support portion 53 has an outer wall 57, a rear wall 59 and an inner wall 55 which form a lower support channel which defines an opening for forward movement of the user's hand and lower forearm, as can be seen in FIGS. 1 and 1A, while the upper forearm is restrained by an upper forearm engaging portion 65 of the cuff. The lower forearm channel may also have an edge or shelf 61 formed on the top of the rear wall 59 so that when the user needs to stand and still have his hand free, he may lean on the crutch with the back of his forearm without gripping the handgrip.

An upper forearm-engaging portion 65 is disposed at an upper end of the elongated cuff 51 and is connected to the lower forearm support portion 53 by a connecting portion 63 of the cuff. The upper forearm engaging portion has an inner wall 71, a forward restraining portion 67 and an outer wall 73 which form an opening for rearward movement of the upper forearm of the user. In the preferred embodiment, the inner wall 71 of the upper forearm engaging portion 65 is connected by the connecting portion 63 of the elongated cuff to the inner wall 55 of the lower forearm channel. The upper forearm engaging portion 65 has a forward restraining portion 67 which restrains the upper forearm from forward movement relative to the elongated cuff. The inner walls of the upper and lower forearm-engaging portions are connected by the connecting portion 63 of the cuff so that the arm is aligned and cannot move laterally toward the body without also moving the cuff. However, an opening is formed between the outer walls 73 and 57, respectively, of the upper and lower forearm engaging portions so that the user's arm can be extracted laterally outwardly from the cuff. The forward restraining portion 67 of the upper forearm-engaging portion 65 may also be provided with a lip or shelf 69 which can be used to hang the crutch freely, as illustrated in FIG. 1A, when the user is not relying on the crutch or when his hands are occupied.

In the preferred embodiment of this invention, the walking aid 1 or 2 is provided as a single, integral unit which cannot be disassembled. The elongated shaft 11 is desirably manufactured from a composite material such as fiberglass or graphite fiber with a rigid foam core. The material selected should be lightweight to reduce the total weight of the crutch or cane so that it can be easily moved about by the user, yet it should be as strong as possible to provide a secure support. Preferably, the handgrip 17 will be integrally joined to the elongated shaft 11 at its upper end 13 and in the embodiment of FIGS. 1-5, the elongated cuff 51 is also integrally joined to the handgrip at the rearward end of the handgrip. That is, the lower forearm support portion 53 of the cuff forms an upwardly inclined channel which is a continuation of the inclined back portion 26 of the handgrip; the inner wall 55 of the lower forearm channel and the inner wall 71 of the upper forearm engaging portion 65 are preferably an integral unit which forms an alignment means for an arm when it is inserted into the opening in the cuff. The cuff and handgrip are particularly contoured to conform to the forearm and the wrist and to provide a seat and a guide which supports the forearm and wrist in a desirable angle relative to the elongated shaft and the body of the user. The handgrip also aligns the thumb and fingers of the hand with the inclined heel-engaging portion 27 and the thumb-supporting 21 and fingers-engaging 23 portions of the handgrip so that the weight on the base of the hand and the thumb and fingers is better distributed throughout the stronger portions of the hand than with conventional crutches and canes.

The invention also comprises a novel foot member 30 for use with any walking aid having an elongated shaft 11. The foot member is disposed at the lower end 15 of the shaft and has a bottom portion 31 formed of resilient material for frictionally engaging a surface during use of the walking aid. The bottom portion of the foot member has upwardly curved forward 39 and rearward ends 37 which allow the foot member to roll in a limited manner when in use. The foot member may also have a curved inner edge 33 to permit the foot member to roll in a limited manner in a lateral direction of the user. Although the crutch and cane of this invention could be used with a conventional foot member, the benefits of the bowed shaft, contoured handgrip and alignment cuff of the walking aid of this invention are enhanced with the novel foot member of this invention, which is curved upwardly on at least its forward and rearward ends, and desirably, also on its inner edge. The foot member has a plurality of narrow concentric grooves or slits 41 depending downwardly from the bottom portion. The curved portions of the foot member allow the crutch to make substantial contact with the ground or other walking surface for the full range of movement. Thus, when the crutch is first extended in a forward direction 10, the curved rearward end 37 of the foot member will grip the surface and hold the frictional engagement as weight is placed on the crutch and the user strides through the full range of motion. The user will not experience the initial instability, typical of a conventional crutch, before the shaft is completely vertical to the ground.

The foot member 30 is typically constructed from rubber or a similar resilient material. It has a socket 45 disposed in an upper portion thereof for receiving the lower end 15 of the elongated shaft 11. The socket will usually be slightly larger at its bottom end than at its top to cause a tighter fit on the shaft. A metal disc or other rigid barrier 32 is disposed in the bottom portion of the foot member below the socket and transversely thereto in a known manner to prevent deterioration and wear of the foot member by the weight of the elongated shaft. Concentric incisions 41, approximately ⅜ inch (0.95 cm.) deep, are made in the bottom portion of the foot member. These incisions may be in a generally elliptical, concentric orientation, as seen in FIG. 15, to cover a substantial portion of the surface of the bottom portion of the foot member. Preferably, these grooves or incisions will spread apart when pressure is applied and the material between each groove will form a frictional engagement with the ground, increasing the gripping power of the bottom surface of the foot member.

Secure lateral movement is also possible with the foot member 30 of this invention because of the upward curve of the inner edge 33 of the foot member as seen in FIGS. 10-14. This allows the user to reach out to his or her side to commence lateral movement, which is similar to the movement in moving forward. The outer side of the foot member may be a flat side surface 35, since there is no need to have it be curved. The forward and rearward ends of the foot member may also have catch means 47, 49, which may comprise upturned hook portions, for reaching and engaging objects, such as doors, which are out of reach of the user's hands.

While the foot member provides additional traction and stability in a crutch or cane of the type disclosed herein, it is expected that the foot member of this invention would prove advantageous when used with other crutches or canes, as well.

Accordingly, the walking aid of this invention provides an elongated shaft which is curved in the forward direction to provide springing action and reduce impact forces on the user. The shaft is integrally connected to the handgrip which is upwardly and rearwardly inclined and forces the portions of the hand to more evenly bear the weight of the user, resulting in reduced stress on the user's wrist. An elongated cuff may also be integrally attached to the handgrip to provide support for the forearm and a restraint to keep it in proper alignment with the wrist and hand. The crutch or cane of this invention is preferably all one piece which can be sized in advance for different users. The angles and degree of curve, as well as its length, can be varied for different heights and weights of users. The shaft can be cut to the proper length for a particular user, and the foot member can be attached to the crutch with self-hardening epoxy adhesive. The longitudinal axis of the foot member is aligned with the direction of movement and the epoxy forms a hard, permanent knob, which anchors the foot in place on the shaft. The knob so formed will be in the proper position for replacement foot members, as needed.

Thus, this invention provides a lightweight, stable crutch or cane which can be constructed without adjustment parts which break and which increase the weight and noise of the crutch. This walking aid is especially adapted to align the hand, forearm and wrist of the user to reduce weight and stress on the wrist and to increase hand control of the crutch. The crutch or cane of this invention further reduces stress from impact forces because of the springiness provided by its bowed shaft. The walking aid of this invention also has a foot member which is stable through a greater range of motion, including lateral motion.

It will be seen that the above-described crutch or cane will achieve the advantages and objects attributed to it, and while it has been described in detail, it is not to be limited to such details except as may be necessitated by the appended claims.

I claim:

1. A walking aid comprising an elongated shaft having an upper and a lower end, said shaft being curved along its longitudinal axis in the plane of the forward direction of said walking aid;

a handgrip having a forward end disposed rearwardly from the upper end of said elongated shaft and being contoured to support a substantial portion of the width of the hand of the user, said handgrip having a thumb-supporting portion in the form of a stop and a fingers-engaging portion disposed at its forward end on opposite sides of its longitudinal axis, said handgrip also having at its rearward end a portion for engaging the heel of a hand, said handgrip being upwardly inclined from its forward to its rearward end;

an elongated cuff having a lower forearm support portion joined to the rearward end of said handgrip and an upper forearm engaging portion disposed at an upper end of said elongated cuff and connected to said lower forearm support portion by a connecting portion of said cuff, said elongated cuff defining an opening for the removal of a forearm in the rearward direction of the walking aid; and a foot member disposed at the lower end of said elongated shaft, said foot member having a bottom portion formed of resilient material for frictionally engaging a surface during use of the walking aid.

2. The walking aid of claim 1 wherein the handgrip is upwardly inclined over its length between the thumb-supporting portion and the heel engaging portion, whereby the thumb and fingers of the user will be aligned downwardly from the user's wrist.

3. The walking aid of claim 2 wherein the handgrip has a projecting portion disposed on its forward end adjacent said elongated shaft, said thumb-supporting portion and said fingers-engaging portion being disposed on opposite sides of said projecting portion.

4. The walking aid of claim 3 wherein the handgrip has an upper surface between said projecting portion and said heel engaging portion, said upper surface being contoured to support the inner surface of the hand of the user and the thumb-supporting portion comprises a shelf contoured to provide a stop for the thumb.

5. The walking aid of claim 1 wherein said handgrip is integrally joined to said elongated shaft at its upper end and said handgrip has a projecting portion projecting upwardly generally along the longitudinal axis of said elongated shaft.

6. The walking aid of claim 1 wherein said handgrip is integrally joined to said elongated shaft and said elongated cuff is integrally joined to the handgrip at the rearward end of said handgrip, the lower forearm support portion of said cuff being inclined upwardly from the heel-engaging portion of the handgrip to receive and support the lower forearm and said upper forearm engaging portion having a restraining portion to restrain the upper forearm of the user from forward movement relative to the elongated cuff.

7. The walking aid of claim 6 wherein the lower forearm engaging portion and the upper forearm engaging portion are integrally joined to each other by said connecting portion of said cuff to form an alignment member to align and support the forearm of the user relative to the handgrip when the walking aid is in use.

8. The walking aid of claim 6 wherein the lower forearm support portion comprises a lower forearm channel having an outer wall, a rear wall and an inner wall, said channel defining an opening for forward movement of the user's hand and lower forearm.

9. The walking aid of claim 8 wherein the upper forearm engaging portion comprises an inner wall, a forward restraining portion and an outer wall, said inner wall being connected by the connecting portion of said elongated cuff to the inner wall of the lower forearm channel and said upper forearm engaging portion restrains forward movement of the upper forearm and forms an opening for rearward movement of the upper forearm of the user.

10. The walking aid of claim 1 wherein the elongated shaft is formed in a generally convex-shaped curve in the plane of forward direction and said shaft is also curved slightly outwardly in a plane lateral to the user.

11. The walking aid of claim 1 wherein the foot member further comprises a socket disposed in an upper portion of said foot member for receiving the lower end of the elongated shaft and said bottom portion is curved from its forward to its rearward end, whereby the foot member may roll evenly through the entire range of its forward movement, said bottom portion further comprising a plurality of narrow concentric grooves depending downwardly to the surface engaged by the foot member, the material of said grooves contacting each other to form a uniform outer surface on said bottom portion when said foot member is not engaging a surface.

12. The walking aid of claim 11 wherein the bottom portion of said foot member also has an inner edge to permit the foot member to roll in a limited manner in a lateral direction from the user.

13. The walking aid of claim 1 wherein the bottom portion of the foot member comprises a plurality of narrow concentric grooves depending downwardly.

14. A walking aid comprising an elongated shaft having an upper end and a lower end, the shaft being formed in a generally convex-shaped curve along its longitudinal axis in the plane of forward direction of said walking aid;

a handgrip having a forward end disposed rearwardly from the upper end of said elongated shaft and being integrally joined thereto, said handgrip being disposed along its longitudinal axis in a rearward direction of said elongated shaft and being contoured to support the hand of the user, said handgrip having a projecting portion disposed at its forward end and projecting upwardly generally along the longitudinal axis of the elongated shaft, said handgrip also having a thumb-supporting portion formed as a shelf contoured to provide a stop for a thumb and a fingers-engaging portion on opposite sides of the projecting portion, said handgrip having at its rearward end a portion for engaging a substantial portion of the width of the heel of a hand, the heel-engaging portion being upwardly inclined from the thumb-supporting portion over the length of the handgrip; and a foot member disposed at the lower end of said elongated shaft, said foot member having a bottom portion formed of resilient material and comprising a plurality of narrow concentric grooves depending downwardly for frictionally engaging a surface during use of the walking aid, said bottom portion being curved from its forward to its rearward end, whereby the foot member may roll evenly through the entire range of its movement.

15. The walking aid of claim 14, further comprising an elongated cuff having a lower forearm support portion integrally joined to the rearward end of said handgrip and an upper forearm engaging portion integrally connected to an upper end of said lower forearm support portion by a connecting portion of said cuff to form an alignment member to align and support the forearm of the user relative to the handgrip when the walking aid is in use, said upper forearm engaging portion having a restraining portion to restrain the upper forearm of the user from forward movement of the upper forearm relative to the elongated cuff, said elongated cuff defining an opening for the forearm in the rearward direction of the walking aid.

16. A walking aid comprising an elongated shaft having an upper and a lower end, said shaft being curved along its longitudinal axis in a generally continuous curve in the plane of the forward direction of said walking aid;

a handgrip having a forward end disposed rearwardly from the upper end of said elongated shaft and being contoured to support a substantial portion of the width of the hand of the user, said handgrip having a projecting portion disposed on its forward end and a thumb-supporting portion in the form of a stop and a fingers-engaging portion disposed on opposite sides of said projecting portion, said handgrip also having at its rearward end a portion for engaging a substantial portion of the heel of a hand, said handgrip being upwardly inclined from its forward to its rearward end; and a foot member disposed at the lower end of said elongated shaft, said foot member having a bottom portion formed of resilient material for frictionally engaging a surface during use of the walking aid.

17. The walking aid of claim 16 wherein the handgrip is upwardly inclined over its length between the thumb-supporting portion and the heel engaging portion thereof, whereby the thumb and fingers of the user will be aligned downwardly from the user's wrist.

18. The walking aid of claim 16 wherein the handgrip has an upper surface between said projecting portion and said heel engaging portion, said upper surface being contoured to support the inner surface of the hand of the user and the thumb-supporting portion comprises a shelf contoured to provide a stop for the thumb.

19. The walking aid of claim 16 wherein said handgrip is integrally joined to said elongated shaft at its upper end and said handgrip has a projecting portion projecting upwardly generally along the longitudinal axis of said elongated shaft.

20. The walking aid of claim 17 wherein the handgrip is upwardly inclined at an angle of approximately 45° to the vertical axis of the elongated shaft.

21. The walking aid of claim 16 wherein the elongated shaft is formed in a generally convex-shaped curve in the plane of forward direction and said shaft is also curved slightly outwardly in a plane lateral to the user.

22. The walking aid of claim 16 wherein the foot member further comprises a socket disposed in an upper portion of said foot member for receiving the lower end of the elongated shaft and said bottom portion is curved from its forward to its rearward end, whereby the foot member may roll evenly through the entire range of its movement, said bottom portion further comprising a plurality of narrow concentric grooves depending downwardly to the surface engaged by the foot member, the material of said grooves contacting each other to form a uniform outer surface on said bottom portion when said foot member is not engaging a surface.

23. The walking aid of claim 22 wherein the bottom portion of said foot member also has an inner edge to permit the foot member to roll in a limited manner in a lateral direction from the user.

24. The walking aid of claim 16 wherein the bottom portion of the foot member comprises a plurality of narrow concentric grooves depending downwardly.

* * * * *